US009388529B2

(12) United States Patent
Lindström et al.

(10) Patent No.: US 9,388,529 B2
(45) Date of Patent: Jul. 12, 2016

(54) SINGLE-STEP METHOD FOR PRODUCTION OF NANO PULP BY ACCELERATION AND DISINTEGRATION OF RAW MATERIAL

(75) Inventors: Mikael Lindström, Lidingo (SE); Daniel Söderberg, Akersberga (SE); Gunnar Henriksson, Solna (SE)

(73) Assignee: INNVENTIA AB, Stockholm (SE)

( * ) Notice: Subject to any disclaimer, the term of this patent is extended or adjusted under 35 U.S.C. 154(b) by 0 days.

(21) Appl. No.: 14/001,450

(22) PCT Filed: Feb. 24, 2012

(86) PCT No.: PCT/SE2012/050209

§ 371 (c)(1), (2), (4) Date: Oct. 2, 2013

(87) PCT Pub. No.: WO2012/115590

PCT Pub. Date: Aug. 30, 2012

(65) Prior Publication Data

US 2014/0014283 A1 Jan. 16, 2014

Related U.S. Application Data

(60) Provisional application No. 61/446,102, filed on Feb. 24, 2011.

(30) Foreign Application Priority Data

Feb. 24, 2011 (SE) ..... 1100122

(51) Int. Cl.

| | |
|---|---|
| ***D21H 11/18*** | (2006.01) |
| ***D21C 9/00*** | (2006.01) |
| ***D21H 11/20*** | (2006.01) |

(52) U.S. Cl.

CPC ..... *D21C 9/007* (2013.01); *D21C 9/002* (2013.01); *D21C 9/004* (2013.01); *D21H 11/18* (2013.01); *D21H 11/20* (2013.01)

(58) Field of Classification Search

CPC ..... D21H 11/18; D21D 99/00; D21C 9/007
USPC ..... 162/28, 261
See application file for complete search history.

(56) References Cited

U.S. PATENT DOCUMENTS

| | | | | |
|---|---|---|---|---|
| 3,834,982 | A * | 9/1974 | Solonitsyn et al. | 162/1 |
| 4,374,702 | A | 2/1983 | Turbak et al. | |
| 4,481,077 | A | 11/1984 | Herrick | |
| 4,831,127 | A | 5/1989 | Weibel | |
| 5,262,003 | A * | 11/1993 | Chupka | D21B 1/32 162/18 |
| 5,964,983 | A | 10/1999 | Dinand et al. | |
| 6,506,282 | B2 * | 1/2003 | Hu | D21C 9/004 162/5 |
| 2007/0137804 | A1 * | 6/2007 | Goto et al. | 162/4 |
| 2008/0078518 | A1 * | 4/2008 | Goto et al. | 162/189 |
| 2010/0282621 | A1 | 11/2010 | Hatanaka et al. | |

FOREIGN PATENT DOCUMENTS

| | | | |
|---|---|---|---|
| CA | 2437616 | A1 | 2/2005 |
| EP | 2196579 | A1 | 6/2010 |
| WO | WO 2010/092239 | A1 | 8/2010 |
| WO | WO 2010/112519 | A1 | 10/2010 |
| WO | WO 2010/125247 | A2 | 11/2010 |
| WO | WO 2011/064441 | A1 | 6/2011 |
| WO | WO 2011/140643 | A1 | 11/2011 |

OTHER PUBLICATIONS

Ankerfors et al., On the manufacture and Use of Nanocellulose, 2007, 9th International Conference on Wood and Biofiber Plastic Composites.*

Dr. Mitroy, Bernoulli equation,,Charles Darwin University, Mar. 19, 2013 [downloaded online Jul. 10, 2015].*

International Search Report and Written Opinion issued on Mar. 22, 2012 for International Application No. PCT/SE2012/050209.

Extended European Search Report issued in European Patent Application No. 12749701.4, on Feb. 23, 2016.

* cited by examiner

*Primary Examiner* — Anthony Calandra

(74) *Attorney, Agent, or Firm* — Knobbe, Martens, Olson & Bear, LLP

(57) ABSTRACT

The invention relates to methods of manufacturing nano pulp, wherein cellulose containing raw material is accelerated in a continuous gas and/or liquid flow, whereby the material is disintegrated and nano pulp is produced. The gas and/or liquid flow may be created by reduction of an elevated pressure in a reactor holding the cellulose containing raw material. The invention also relates to the nano pulp produced.

8 Claims, No Drawings

SINGLE-STEP METHOD FOR PRODUCTION OF NANO PULP BY ACCELERATION AND DISINTEGRATION OF RAW MATERIAL

RELATED APPLICATIONS

This application is a U.S. National Phase of International Application No. PCT/SE2012/050209, filed Feb. 24, 2012, designating the U.S., and published as WO 2012/115590 on Aug. 30, 2012 which claims the benefit of U.S. provisional Patent Application No. 61/446,102 filed Feb. 24, 2011 and Swedish Patent Application No. 1100122-9 filed Feb. 24, 2011.

The present invention relates to a method of manufacturing nano pulp, and in particular to an energy efficient method for manufacture thereof. Also disclosed is nano pulp obtainable by said method.

BACKGROUND

In EP 1984561, one method for manufacturing nano-sized, microfibrillated cellulose by the use of a homogenizer is disclosed, whereby homogenizer clogging may ensue.

Another problem when manufacturing nano fibers from cellulose containing raw materials is the high energy consumption. Hence, there exists a need for alternative, energy-efficient methods for manufacturing nanocellulose qualities, such as microfibrilated cellulose. Moreover, there exists a need for a method that enables manufacture of such nanofibrilated cellulose from a wide variety of cellulose containing raw materials.

DESCRIPTION OF THE INVENTION

In accordance with the present invention, there is provided a method that enables continuous, energy-efficient manufacture of nano pulp. Nano pulp is herein defined as cellulose containing material disintegrated into fibrils and particles with cross section diameters in the interval of from 10 nm to 250 nm. The material is similar to microfibrilated cellulose but may be less homogenous.

In a first aspect, there is provided a method of manufacturing nano pulp wherein cellulose containing raw material is accelerated in a continuous gas and/or liquid flow, whereby the material is disintegrated and nano pulp is produced. The continuous method of the present invention shall be discerned from the pulsating flow through e.g. a homogenizer or refiner. The continuous method of the invention may have a running time from e.g. 10 seconds, e.g. from 20 seconds. The flow may be generated by an upstream elevated pressure and the cellulose containing raw material can be present in a reactor, or may be transported into the gas and/or liquid flow by the use of a screw transporter. After acceleration in the gas and/or liquid flow, nano pulp may be collected in e.g. a cyclone. According to calculations, this first aspect of the invention may provide nano cellulose at an energy input reduced by ⅔, compared with conventional methods for manufacturing microfibrillated cellulose.

In a first embodiment of the invention, the cellulose containing raw material is in a reactor with elevated pressure, and said gas and/or liquid flow is created by reduction of the elevated pressure, whereby fibres and other material in the cellulose containing raw material rapidly accelerate.

Since no homogenizer or refiner is used in accordance with the invention, the problem of clogging is circumvented.

The raw material in the reactor may be heated until a suitable pressure builds up in the reactor. In one embodiment, 1-4% of the cellulose containing raw material, by weight, in water suspension is heated to 180° C. in a closed reactor. The fibres are subsequently accelerated through an outlet, at reduced pressure, whereby the cellulose containing material disintegrates. The lower pressure may be ambient pressure, or any chosen elevated pressure that is still low enough to accomplish a sufficient pressure difference in relation to the elevated pressure, to obtain nano pulp. Pressure may thus be lowered in several steps, thus causing several subsequent accelerations. The nano pulp produced by this acceleration leaving the reactor through the outlet may be collected in e.g. a cyclone.

In a third embodiment, the gas flow is a steam flow. In addition to the pressure reduction, the ensuing rapid production of steam, at the pressure reduction, may further facilitate disintegration of the cellulose containing raw material. The steam flow with the undisintegrated or partly disintegrated cellulose containing raw material may pass through a contracting nozzle, which can be a Venturi tube or a Laval nozzle. In addition, the outlet from the contracting nozzle may cause a stepped, sudden expansion.

Whereas the method of EP 1984561 results in homogenous, microfibrillated cellulose, the present invention provides an adjustable method of manufacturing nano cellulose. By adjusting the flow speed and/or elevated pressure in the reactor, as well as pressure reduction speed and geometry, if applicable, it is possible to produce homogenous as well as heterogenous nano cellulose. The nano cellulose may hence comprise fibrils and other particles from a nano spectrum up to a size with cross section diameters in the interval of from 10 nm to 250 nm. Compared with state of the art methods, the present invention provides a method with considerably lower energy consumption, which is moreover easier to scale up industrially.

In a fourth embodiment, the fibres of the pulp are pretreated by way of milling (i.e. beating in equipments similar to the ones used for beating of paper pulps), enzymatic degradation (e.g. pre-incubation of the cellulose containing raw material with endoglucanase), introduction of charges (using for instance sodium hypochlorite with TEMPO as catalyst (2,2,6,6,-tetramethylpiperidinyloxy radical)), carboxymethylation (by incubation of cellulose containing raw material with chloroacetic acid under alkaline conditions), acidic hydrolysis (pre-incubation of cellulose containing raw materials with strong acids and temperatures over 50° C.), alkaline hydrolysis (preincubation of cellulose containing raw materials at high pH ant temperatures over 70° C.), or a combination of any of the aforementioned methods. Such pre-treatments weaken the fibres, and hence may increase the yield of nano pulp produced.

The pH of the cellulose containing raw material being accelerated in a gas and/or liquid flow is immaterial. The pH of the cellulose containing raw material may be the pH suitable for or resulting from e.g. the pre-treatment of the cellulose containing raw material.

In a fifth embodiment, the gas and/or liquid flow steam has a flow speed in the interval from 50 to 1000 m/s.

The pressure in the reactor may in accordance with the first embodiment of the invention be in the interval from 2 to 13 bar, for example approximately 9 bar. In one embodiment, the reactor is heated to approximately 170° C. to obtain a pressure of 8 bar therein. In another embodiment, the elevated pressure in the reactor is reduced to a pressure in the interval of from 1 to 2 bar.

The present method enables the manufacture of nano pulp from a wide variety of cellulose containing raw materials. In one embodiment, the cellulose containing raw material is biomass. In another embodiment, the cellulose containing raw material is plant biomass, such as e.g. sawdust. In yet an embodiment, the cellulose containing raw material is pulp. Ascidians may also be made use of in accordance with the present invention.

The cellulose containing raw material may comprise a minor proportion of parenchymal cells. Such proportion may be up to 10% by weight, or up to 5% by weight, of the total weight of the cellulose containing raw material.

In one embodiment, the biomass or plant biomass used as raw material has a dry content that amounts to 1-40%, by weight, of the cellulose containing raw material. In another embodiment, the pulp used in the invention has a dry content that amounts to 1-10%, by weight, of the cellulose containing raw material. In yet another embodiment, the pulp has a dry content that amounts to 1-5%, by weight, of the cellulose containing raw material. The balance constitutes water.

The conditions used, e.g. flow speed of steam, temperature, pressure(s), and possible pre-treatment(s), influence the rate and extent of disintegration of fibres. It is possible to obtain homogenous pulp containing partially disintegrated fibres, or heterogenous mixtures of well disintegrated fibres combined with less disintegrated fibres. The person skilled in the art realizes that the above-mentioned conditions may be adjusted to obtain a suitable product.

Hence, in one aspect of the invention, there is provided nano pulp consisting of fibrils and particles with cross section diameters in the interval of from 10 to 250 nm. The cross section diameters of fibrils and particles may be in the interval of from 30 to 250 nm, e.g. from 40 to 250 nm. In another aspect of the invention, there is provided nano pulp produced in accordance with the method described herein, wherein the nano pulp consists of fibrils and particles with cross section diameters in the interval of from 10 to 30 nm.

The invention shall now be described in more detail with reference to the below examples of embodiments, which are however only intended to illustrate the invention and in no way whatsoever limit its scope.

EXAMPLES

Methods of Production of Nano Pulp

Examples 1 and 2 are in accordance with the first embodiment of the invention, whereas Examples 3-5 are in accordance with the first aspect of the invention.

1. Nano Pulp Made from Kraft Pulp.

A fully bleached (totally chlorine free) softwood was treated with TEMPO (2,2,6,6,-tetramethylpiperidinyloxy radical)-catalyzed oxidation, beaten with PFI-mill and incubated with endoglucanase. TEMPO oxidation was done with sodium hypochlorite as oxidant and TEMPO and sodium bromide as catalysts, similar as described by Kato et al (Carbohydrate Polymers 51, 69-75). The treated pulp was treated in accordance with the first embodiment of the invention (see above). The result was characterized with light microscopy, scanning electron microscopy (SEM), and atomic force microscopy (AFM). Light microscopy showed that the pulp has been divided into smaller components. This proves that the pulp has been disintegrated into smaller fibrilar particles.

In light microscopy it is not possible to see smaller particles. Therefore the treated pulp was also examined with SEM and AFM. Both techniques indicated that the nano pulp contained fibrilar particles of very small size, i.e., ca 15-30 nm in diameter and around 1 μm long.

2. Nano Pulp Made from Dissolving Pulp.

Dissolving pulp made by the acidic sulphate method was treated in accordance with the first embodiment of the invention (see above). The pulp was pretreated by 20 000 revolutions on PDF mill, and analyzed with light microscopy. The pulp was also subjected to TEMPO oxidation and analyzed in light microscopy.

3. Nano Pulp Made from Chemo Thermo Mechanical Pulp.

This pulp was subjected to the method according to the first aspect of the invention, i.e. acceleration in a steam flow. The result was characterized using light microscopy. The amount of smaller particles and broken fibers were drastically increased.

4. Dissolving Pulp.

This pulp was pretreated with acid and thereafter subjected to the method according to the first aspect of the invention (acceleration in steam flow). Results were characterized by light microscopy. As in the other experiments, fibers were partly disintegrated.

5. Sawdust.

Sawdust was without pretreatment subjected to the method of the first aspect of the invention (acceleration in steam flow). The result was examined with light microscopy. The effect of the method was in this case weaker than in the above examples, but smaller particles were created also here.

| | Characterization using light | Characterization using Scanning | Characterization using atomic force |
|---|---|---|---|
| Example | microscopy | electron microscopy | microscopy |
| 1 | Fibrils with diameter of around 0.25 μm and length of at least 24μ. Also larger fragments and fibrils were present up to almost intact cell walls. | Fibrils with a diameter of around 13 nm and length of at least 240 nm. Also thicker and shorter fibers were present. | Fibrils with a diameter of around 22 nm and length of at least 1080 nm. Also shorter fibrils were present. |
| 2 Pretretment with beating | Fibrils with diameter of around 0.3 μm and length of at least 150μ. Also larger fragments and fibrils were present up to diameter of approximaterly 15 μm. | * | * |
| 2 Pretreatment with TEMPO oxidation | Similar as above but more disintegrated. Almost no larger fiber fragments remained. | * | * |
| 3 | Fibrils with diameter of around 0.25 μm and length of at least 20μ. Also larger | * | * |

-continued

| | Characterization using light | Characterization using Scanning | Characterization using atomic force |
|---|---|---|---|
| | fragments and intact fibrils were present. | | |
| 4 | Fibrils with diameter of around 0.25 μm and length of at least 5μ. Also larger fragments and intact fibrils were present. Visible fibers appeared to be shorter than in experiment 3. | * | * |
| 5 | Particles and fibrils with less than 1 μm was created. Larrger particles also present. | * | * |

* This type of microcopy was used for these examples. This does not exclude that small fibers under the detection limit of light microcopy are present in the material.

Pre-Treatments of Fibres of Pulp

The below pre-treatment may be utilized individually or in combination.

Enzymatic Pre-Treatment

The enzyme used was a neat cellulase of the endoglucanase type (commercially available under the name Novozym 471) (Novozymes A/S Krogshoejvej 36 DK-2880 Bagsvaerd, Denmark). 27 ECU (enzyme activity units) was used per gram of pulp. The enzymatic pre-treatment was carried out during 1 hour at 50° C. and pH 7. The enzymatic pre-treatment is described in detail in Henriksson M, Henriksson G, Berglund L A and Lindstrom T (2007) "An environmentally friendly method for enzyme-assisted preparation of nano pulp (MFC) nanofibers" European Polymer Journal, 43, 3434-3441.

Introduction of Charges (TEMPO Oxidation)

Oxidation of cellulose with TEMPO as catalyst introduces carboxylic acids in the cellulose, which leads to swelling and facilitates delamination. For the TEMPO oxidation, a mixture of 0.15 g TEMPO; 12 g NaClO; and 1.5 g NaBr was added to 60 g of fibres; pH was held at approximately 10.5 throughout the oxidization by addition of NaOH. The oxidization was carried out at ambient temperature during approximately 2 h.

Beating

Beating of fibres was carried out using a laboratory scale mill of PFI type. The intensity was varied by changing the RPM. 8000, 10 000 25 000 RPM was used. Industrially, other kinds of milling would be made use of.

Acidic Hydrolysis

The acidic hydrolysis consisted of a short-term treatment with sulphuric acid. A pulp suspension was adjusted to pH 1 using sulphuric acid and was incubated for 1 h at 50° C.

Energy Consumption

The present invention for manufacture of nano pulp exhibits a substantially lower energy demand, as compared with methods for manufacturing MFC by conventional methods.

Preliminary results and calculations show an energy demand for the method of manufacturing nano pulp in accordance with the invention to be in the range of from 100 kWh/t to 500 kWh/t. This can be compared with the reported values in literature for MFC manufacture of 1500 to 70000 kWh/t.

What is claimed is:

1. A method of manufacturing nano pulp comprising:

accelerating cellulose containing raw material consisting of wood pulp in a continuous steam flow or a continuous steam and liquid flow, wherein dry content of the wood pulp is 1-5% by weight, and wherein the cellulose containing raw material is heated in a closed reactor to build up an elevated pressure and the continuous steam flow or the continuous steam and liquid flow is created by reduction of the elevated pressure to a pressure of from 1 to 2 bar, whereby the raw material is disintegrated and nano pulp is produced.

2. The method according to claim 1, wherein the cellulose containing raw material is pre-treated by milling, enzymatic degradation, introduction of charges, carboxymethylation, acidic hydrolysis, alkaline hydrolysis, or a combination thereof.

3. The method according to claim 1, wherein the continuous steam flow or the continuous steam and liquid flow has a flow speed of from 50 to 1000 m/s.

4. The method according to claim 2, wherein the pressure in the reactor is from 2 to 13 bar.

5. The method according to claim 4, wherein the pressure in the reactor is approximately 9 bar.

6. A method of manufacturing nano pulp comprising accelerating cellulose containing raw material consisting of wood pulp in a continuous steam flow, wherein dry content of the wood pulp is 1-5% by weight, and wherein the continuous steam flow is generated by an upstream elevated pressure and the cellulose containing raw material is transported into the continuous steam flow, and wherein the raw material is disintegrated and nano pulp is produced.

7. The method according to claim 6, wherein the cellulose containing raw material is pre-treated by milling, enzymatic degradation, introduction of charges, carboxymethylation, acidic hydrolysis, alkaline hydrolysis, or a combination thereof.

8. The method according to claim 6, wherein the continuous steam flow has a flow speed of from 50 to 1000 m/s.

* * * * *